US005730537A

United States Patent [19]

Kelly et al.

[11] Patent Number: 5,730,537

[45] Date of Patent: Mar. 24, 1998

[54] PRINT MEDIA HANDLING AND EJECTION SYSTEM

[75] Inventors: Kieran B. Kelly, Vancouver; Allan G. Olson, Camas; Gene D. Jones, Yacolt, all of Wash.

[73] Assignee: Hewlett-Packard Company, Palo Alto, Calif.

[21] Appl. No.: 821,969

[22] Filed: Mar. 13, 1997

[51] Int. Cl.[6] ..... B41J 11/58; B41J 2/00

[52] U.S. Cl. ..... 400/625; 271/264; 347/104

[58] Field of Search ..... 347/104; 400/624, 400/625, 628, 629, 635; 271/264, 272, 275, 109, 225

[56] References Cited

U.S. PATENT DOCUMENTS

| | | | |
|---|---|---|---|
| 4,212,456 | 7/1980 | Ruenzl | 400/625 |
| 4,682,770 | 7/1987 | Konda | 400/625 |
| 5,015,109 | 5/1991 | Brandon et al. | 400/624 |
| 5,226,743 | 7/1993 | Jackson et al. . | |
| 5,409,209 | 4/1995 | Nakamura et al. | 347/104 |
| 5,420,621 | 5/1995 | Richtsmeier et al. . | |
| 5,427,462 | 6/1995 | Jackson et al. . | |
| 5,489,159 | 2/1996 | Abbott et al. | 400/624 |
| 5,506,606 | 4/1996 | Saikawa et al. | 347/104 |
| 5,524,842 | 6/1996 | Kida et al. | 400/629 |
| 5,615,873 | 4/1997 | Kobayashi et al. | 347/104 |

*Primary Examiner*—Eugene H. Eickholt

[57] ABSTRACT

A second feed roller of smaller diameter than a first feed roller is included in a media handling system. A print zone is located adjacent to the second feed roller away from the first feed roller to lower the location of the print zone. During ejection, a pivot mechanism moves from a first position adjacent to the printhead to an intermediary position. This causes arms to extend and rails to retract. The motions then pause and/or reverse, prior to full extension and full retraction. Next, the pivot mechanism moves to a second position causing the arms to fully extend and the rails to fully retract. The varied motion (e.g., pause and/or reversal) assures that the arms push at an edge of the media sheet to reliably move a media sheet into an output tray without the media sheet sailing from the printer.

22 Claims, 7 Drawing Sheets

PRINT MEDIA HANDLING AND EJECTION SYSTEM

BACKGROUND OF THE INVENTION

This invention relates generally to inkjet printers, and more particularly to media handling and ejection systems.

Conventional inkjet printers tend to have a shape which is tall and shallow compared to laser printers, for example, which have shapes which are of moderate height and broad depth. Inkjet printer height is determined by the cumulative height of various components. Height of a typical inkjet printer is determined by summing the input paper tray height, the feed roller diameter, the printhead height, and the cumulative height of various mechanisms, such as portions of the casing. Reducing printer height, without compromising performance and features is desirable.

For inkjet printers as with other printers, it is an ongoing desire to improve printing speed without compromising print quality. For multi-sheet print jobs one of the tradeoffs in determining print speed is ink drying time. One does not want a currently printing media sheet to cause a previous media sheet to smear. Because media sheets are to be stacked, it is known to elevate the currently printing media sheet above the output stack for a time so as to avoid smearing. For example, before ejecting a media sheet into an output tray, a conventional inkjet printer first ejects the sheet onto a set of rails above the output tray. The rails serve to isolate the current media sheet from a prior media sheet and to hold the media sheet level so that the portion of the media sheet within a print zone stays flat. The media sheet later is dropped onto the output tray before the next media sheet is ejected. To move the media sheet off the rails, the rails typically are retracted toward outer walls adjacent to the output tray. When the media sheet fails from the rails into the output tray, the media sheet sometimes sails from the output tray onto the desktop or floor. Accordingly, it is desirable to achieve a reliable ejection method for placing media sheets into the output tray.

SUMMARY OF THE INVENTION

According to the invention, a print media handling and ejection system enables reduced height of an inkjet printer and reliable media sheet ejection into an output tray.

According to one aspect of the invention, a second feed roller of smaller diameter than a first feed roller is added to a media handling system of an inkjet printer. A print zone within which ink is printed onto a media sheet is located adjacent to the second feed roller away from the first feed roller. In effect this lowers the location of the print zone from the top of the first feed roller to the top of the second feed roller. One advantage of the smaller diameter second feed roller is that the inkjet printer height is based, in part, on the diameter of the second feed roller, rather than that of the first feed roller. The beneficial effect is that inkjet printer height is reduced. An advantage of a larger diameter first feed roller is that stiff media such as envelopes and cardstock paper can be wrapped around the large diameter first feed roller when fed from an input stack along a media path. As a result, such envelopes and card stock paper can be fed along the media path for printing.

According to another aspect of the invention, a pivot mechanism within the print zone of an inkjet printer includes an arm which pushes the media sheet off the pivot mechanism after printing. The pivot mechanism moves between a first position for supporting a media sheet adjacent to a printhead of an inkjet pen, and a second position for allowing a media sheet to sag down away from the printhead. During dispersal of ink from the printhead, the pivot mechanism is in the first position. As printing completes toward the trailing edge of the media sheet, the pivot mechanism rotates away from the printhead. The arm acts upon the media sheet as the pivot mechanism moves to the second position. Specifically, the arm pushes the media sheet away from the second feed roller and print zone toward an output area of the printer.

According to another aspect of the invention, print media ejection involves multiple actions of the pivot mechanism and arm. Initially during printing, the pivot mechanism is in the first position supporting the media sheet adjacent to the printhead. In addition, the arm is retracted so as not to extend above a support surface of the pivot mechanism which contacts the media sheet. The printer includes rails in the output area above an output tray. The rails are in an extended position, during printing, supporting the currently printing media sheet above the output tray. When the print media clears the second feed roller, the pivot mechanism rotates down toward the second position. The rotation action of the pivot mechanism triggers the rails to begin to retract and the arm to rotate toward the output region. When the pivot mechanism is at a specific intermediate position between the first position and second position, the pivot mechanism stops and begins to rotate back toward the first position. While at the intermediary position, the rails are slightly retracted. Specifically, the rails are retracted by a sufficient amount for the media sheet to be free to drop from the rails into the output tray. The retraction motion of the rails is an upward rotational motion which partially lifts the media sheet before the media sheet clears the rails and drops into the output tray. The rails lift the lead portion of the media sheet more than the trailing portion. As a result, the media sheet is biased back toward or onto the pivot mechanism and the arm.

Once the pivot mechanism stops at the intermediary position and reverses to rotate back toward the printhead, the rails also stop and rotate back toward the extended position. In addition, the arm mechanism retracts partially into the pivot mechanism. Before or during the reversal action, the media sheet is expected to have already cleared the rails and fallen toward the output tray and pivot mechanism. This reversal action allows time for the media sheet to settle. In addition, the reversal action moves a distal tip of the arm out from under the media sheet. The pivot mechanism then recommences movement toward the second position again causing the arm to push the media sheet from the pivot mechanism. The reverse then forward motion assures that the arm pushes at an edge of the media sheet to reliably move the media sheet into the output tray. In some embodiments the arm pushes the media sheet clear of a post between a media sheet output stack and the pivot mechanism. The arm pushes the trail edge of media sheet onto the output stack.

One advantage of the ejection method is that media sheets are moved from the rails to the output tray (i) without the media sheet sailing out of the output tray onto a desktop or floor, and (ii) without the media sheet getting stuck on the pivot mechanism and interfering with subsequent print cycles. Another advantage is that the reversal action frees the arm from the media sheet. Still another advantage is that the forward, reverse, forward action more reliably frees the media sheet from the rails. This is particularly beneficial for short or stiff media such as envelopes, which otherwise may get stuck on the rails.

According to another aspect of the invention, the pivot mechanism merely pauses at the intermediary position rather than reversing toward the first position. This increases printer throughput and is particularly useful for an economical fast print mode.

According to another aspect of the invention, paper length is monitored while in economical fast mode to determine whether to revert to a normal mode in which pivot reversal action occurs. For example for shorter print media, the normal cycle may be preferred to assure that the media sheets clear the rails.

According to another aspect of the invention, the normal mode is slowed to a decreased speed to define a glossy mode for printing glossy media sheets. Such media tend to be more slippery. By slowing the cycle a glossy media sheet moves more gently into the output tray.

According to another aspect of the invention, each rail has a first portion closest to the print zone which is generally level with the print zone and a second portion furthest from the print zone which angles upward away from the output tray. As a result each rail is higher above the output tray at a first end furthest from the print zone, than at a second end closest to the print zone. An advantage of such rail contour is that the media sheet tends to angle toward the print zone and pivot mechanism as the rails retract. The beneficial effect is that sailing of the media sheet out of the output tray when falling is avoided. Another benefit of angling the media up is that sag of the media between the rails down toward the output tray is reduced. Thus, the current sheet does not sag down into contact with previously printed sheets in the output tray.

These and other aspects and advantages of the invention will be better understood by reference to the following detailed description taken in conjunction with the accompanying drawings.

DESCRIPTION OF SPECIFIC EMBODIMENTS

Overview—Conventional Ejection Process

Figure 1:
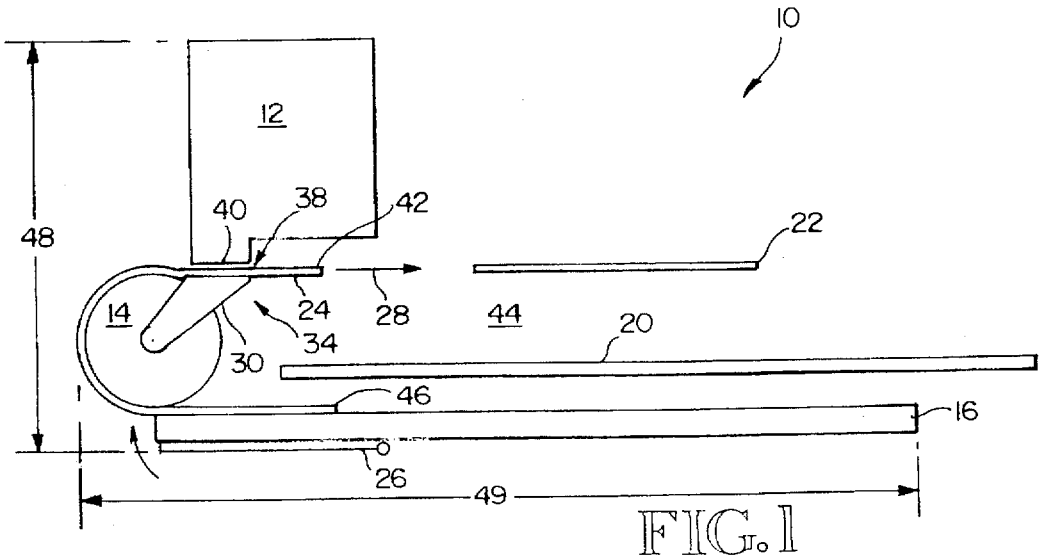
FIG. 1 PRIOR ART
FIG. 1 is a diagram of a portion of a conventional inkjet printer having a conventional pivot mechanism in a first position adjacent to a printhead.
Figure 2:
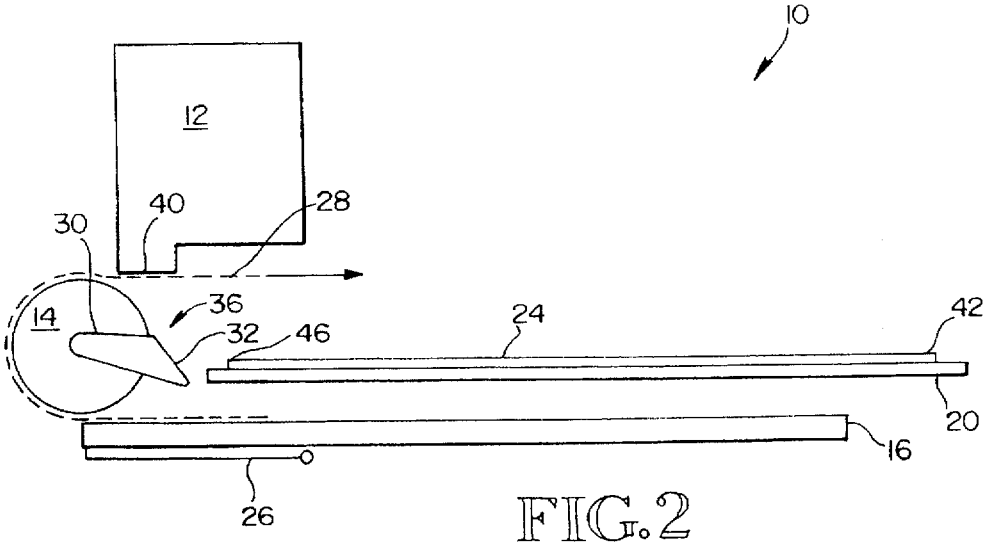
FIG. 2 PRIOR ART
FIG. 2 is a diagram of the inkjet printer portion of FIG. 1 in which the conventional pivot mechanism is in a second position away from the printhead.

FIG. 1 shows a portion 10 of a conventional inkjet printer having an inkjet pen 12, a pick and feed roller 14, an input tray 16, an output tray 20 and rail extensions 22. To print to a media sheet 24 the media sheet is picked from the input tray 16. At the start of the pink cycle a pressure plate 26 rises to lift the input paper stack in the input tray 16 toward the pick and feed roller 14. The pick and feed roller 14 picks the top media sheet 24 and moves the media sheet 24 along a media path 28. A conventional pivot mechanism 30 is coupled to the roller 14. The pivot mechanism 30 moves between a first position 34 (as shown in FIG. 1) and a second position 36 (as shown in FIG. 2). The pivot mechanism includes a support surface 32.

While the inkjet pen 12 prints to the media sheet 24, the pivot mechanism 30 is in the first position 34. While in the first position 34, a print zone 38 is formed between the support surface 32 and the inkjet pen's printhead 40. As the media sheet 24 moves along the media path 28, a changing portion of the media sheet 24 moves into the print zone 38 to receive ink. After passing through the print zone 38, a lead edge 42 of the media sheet 24 moves into an output area 44 where the rail extensions 22 and output tray 20 are located. The lead edge 42 moves onto the rail extensions 22 and is held above the output tray 20. As the print cycle continues more and more of the media sheet 24 moves along the rail extensions 22 above the output tray 20. The purpose of the rail extensions 22 is to elevate the currently printing media sheet 24 above a stack of previously printed media sheets. By doing so, the currently printing media sheet 24 is given more time to dry before being placed on the stack. In addition, the media sheet at the top of the output tray stack is given more time to dry. This prevents smearing of ink on the currently printing media sheet 24 or a previously printed media sheet.

Once the trailing edge 46 of media sheet 24 moves off the feed roller 14, the pivot mechanism 30 begins to move to the second position 36. In addition, the rail extensions 22 retract. The media sheet 24 slides from the support surface 32 and falls from the rail extensions 22 into the output tray 20. The absence of the rail extensions 22 from the diagram of FIG. 2 represents the retraction of the rail extensions 22. Conventionally, the pivot mechanism 30 moves at a constant, uninterrupted rate when moving from the first position 34 to the second position 36. Similarly, the rail extensions 22 retract at a constant, uninterrupted rate when releasing the media sheet 24 to the output tray 20.

Note that the height of the conventional inkjet printer embodying FIGS. 1 and 2 is at least the cumulative height 48 of the input tray 16, the feed roller 14 and the inkjet pen 12. In addition other mechanisms and casing add to the overall height of the printer. The depth of the inkjet printer is at least the cumulative depth 49 of the input tray length and the radius of the feed roller 14.

Overview—Media Handling and Ejection System

Figure 3:
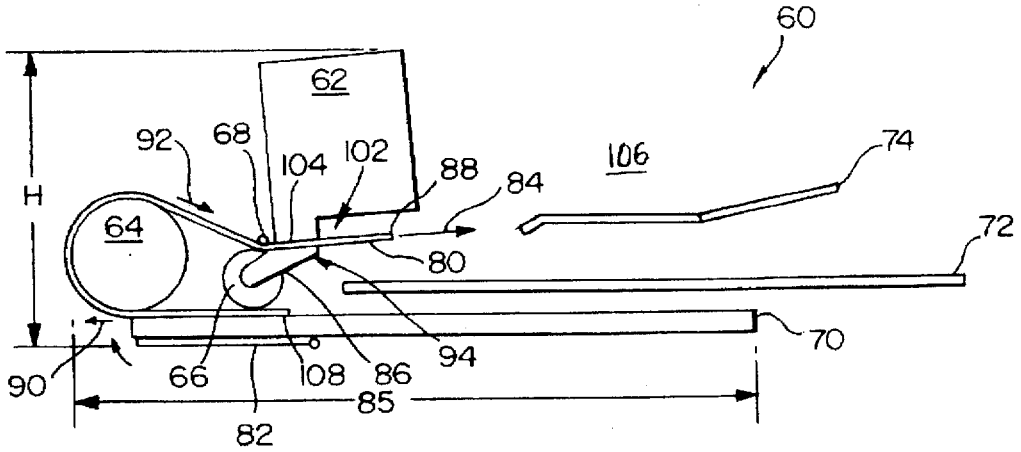
FIG. 3 is a diagram of a portion of an inkjet printer according to an embodiment of this invention, in which a pivot mechanism of this invention is in a first position adjacent to a printhead.

FIG. 3 is a diagram of a portion 60 of an inkjet printer according to an embodiment of this invention. The inkjet printer includes an inkjet pen 62, a pick and feed roller 64, a second feed roller 66, a pinch roller 68, an input tray 70, an output tray 72 and rail extensions 74. To print to a media sheet 80 the media sheet is picked from the input tray 70. At the start of the pick cycle a pressure plate 82 rises to lift the input paper stack in the input tray 70 toward the pick and feed roller 64. The pick and feed roller 64 picks the top media sheet 80 and moves the media sheet 80 along a media path 84. The lead edge 88 of the media sheet 80 is moved off the input stack in a first direction 90. The media sheet 80 moves along the first feed roller (pick and feed roller 64) and is fed toward the second feed roller 66. The lead edge 88 of the media sheet 80 moves off the first feed roller 64 in a direction 92 which is at least 180 degrees different than the first direction 90. Thus, the media sheet 80 is wrapped around at least a 180 degree arc of the first feed roller 64. The second feed roller 66 has a smaller diameter than the first feed roller 64. Also, the second feed roller 66 extends to a lesser height relative to the input tray 70 than the first feed roller 64.

Figure 4:
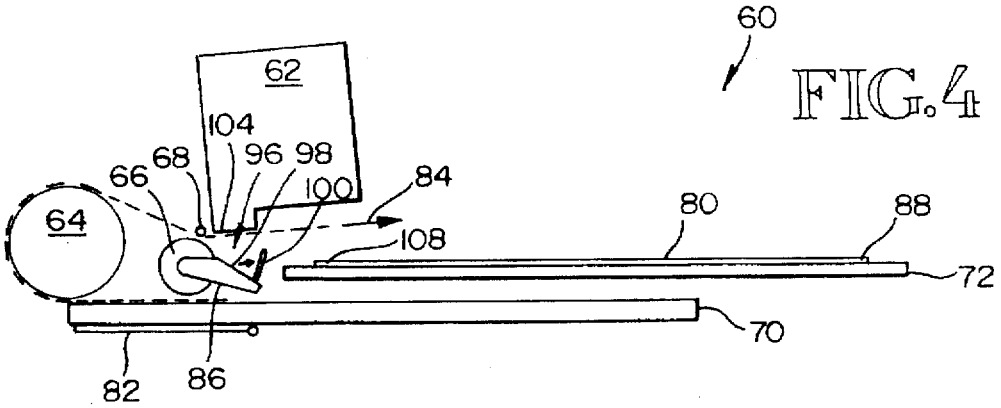
FIG. 4 is a diagram of the inkjet printer portion of FIG. 3 in which the pivot mechanism is in a second position having an arm extended according to an embodiment of this invention.

A pivot mechanism 86 according to an embodiment of this invention is coupled to the second feed roller 66. The pivot mechanism 86 moves between a first position 94 (as shown in FIG. 3) and a second position 96 (as shown in FIG. 4). The pivot mechanism includes a support surface 98 and one or more arms 100. In one embodiment there are two arms 100 spaced along the length of the support surface 98.

While the inkjet pen 62 prints to the media sheet 80, the pivot mechanism 86 is in the first position 94. While in the first position 94, a print zone 102 is formed between the support surface 98 and the inkjet pen's printhead 104. As the media sheet 80 moves along the media path 84, a changing portion of the media sheet 80 moves into the print zone 102 to receive ink. The lead edge 88 of the media sheet 80 moves into an output area 106 where the rail extensions 74 and output tray 72 are located. The lead edge 88 moves onto the rail extensions 74 and is held above the output tray 72. As the print cycle continues more and more of the media sheet 80 moves along the rail extensions 74. The purpose of the rail extensions is to elevate the currently printing media sheet 80 above a stack of previously printed media sheets. By doing so, the currently printing media sheet 80 is given more time to dry before being placed on the stack. In addition, the media sheet at the top of the output tray stack is given more time to dry. This prevents smearing of ink on the currently printing media sheet 80 or a previously printed media sheet.

Once the trailing edge 108 of media sheet 80 moves out of the grasp of the pinch roller 68 and feed roller 66, the pivot mechanism 86 moves away from the first position 94 toward the second position 96. In addition, the rail extensions 74 retract and the arms 100 extend. The media sheet 24 is pushed from the support surface 98 by the arms 100 and falls from the rail extensions 74 into the output tray 72. The movement of the pivot mechanism 86 and the rail extensions 74 is not at a constant rate like the conventional pivot mechanism 30 and rail extensions 22. According to an aspect of the invention, the motion of the pivot mechanism 86 is interrupted, instead, and in some embodiments reversed in part before finally moving to the second position 96. Similarly the motion of the rail extensions 74 is interrupted, and in some embodiments is reversed in part before finally moving to the retracted position. The absence of the rail extensions 74 from the diagram of FIG. 4 represents the retraction of the rail extensions 74. The movement of the arms 100 relative to the support surface 98 also is paused, and in some embodiments reversed before finally moving to a fully extended orientation.

According to another aspect of the invention the height of the inkjet printer portion 60 is reduced compared to that of the conventional inkjet printer portion 10. Specifically, by including the second feed roller 66 along the feed path 84 between the print zone 102 and the first feed roller 64, the height of the print zone 102 relative to the input tray 70 is decreased. The second feed roller 66 has a smaller diameter than the first feed roller 64 and extends to a lesser height above the input tray 70 than the first feed roller 64. The diameter of the first roller is relatively larger than that of the second roller to enable relatively stiff media such as envelopes and cardstock paper to be fed through the printer. Specifically, the diameter of the first roller is large enough for such media to wrap around the first roller without creasing the media. Thus, envelopes and cardstock paper are able to be picked from an input tray, wrapped partially around the first roller, and fed toward the second roller and print zone for printing.

The print zone 102 occurs at a height approximating the height of the second feed roller 66 relative to the input tray 70. The height of the inkjet printer embodying FIGS. 3 and 4 is at least the cumulative height H of the input tray 70, the second feed roller 66 and the inkjet pen 62. In addition other mechanisms and casing add to the height. The depth of the inkjet printer remains at least the cumulative depth 85 of the input tray length and the radius of the feed roller 14. Note, however, the stack of media sheets in the output tray extends farther compared to that of the conventional inkjet printer embodied in part by FIGS. 1 and 2.

Pivot Mechanism

Figure 5:
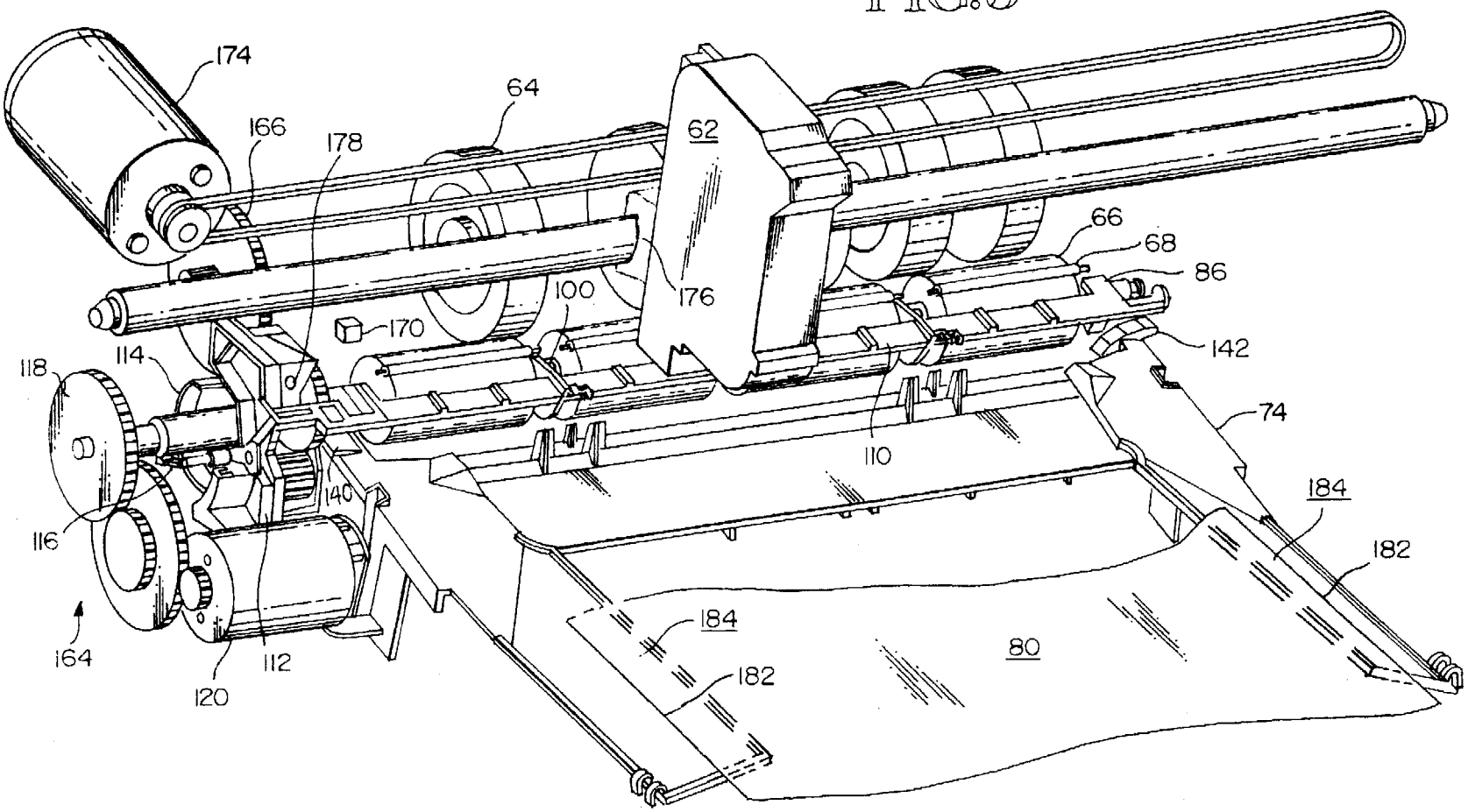
FIG. 5 is a perspective view of a portion of an inkjet printer having a pivot mechanism according to an embodiment of this invention.

FIG. 5 shows a portion of an inkjet printer including the pivot mechanism 86 according to an embodiment of this invention. The pivot mechanism 86 includes a platen 110 extending the width of the media path. The pivot mechanism is coupled to a link 116. The link 116 is coupled to a kick/pick transmission 114. The link 116 couples the pivot mechanism 86 to the kick-pick transmission 114. The transmission 114 is disengagably linked to a gear transmission 164 via a rocking mechanism 112. A drive motor 120 is coupled to the gear transmission 164 and drives the gear transmission 164. The feed roller 66 is driven by the motor 120 via the gear transmission 164. The pivot mechanism 86 is driven by the motor 120 when the rocking mechanism 112 engages the kick/pick transmission 114 to the gear transmission 164. The arms 100 are located along the length of the platen 110.

Figure 6:
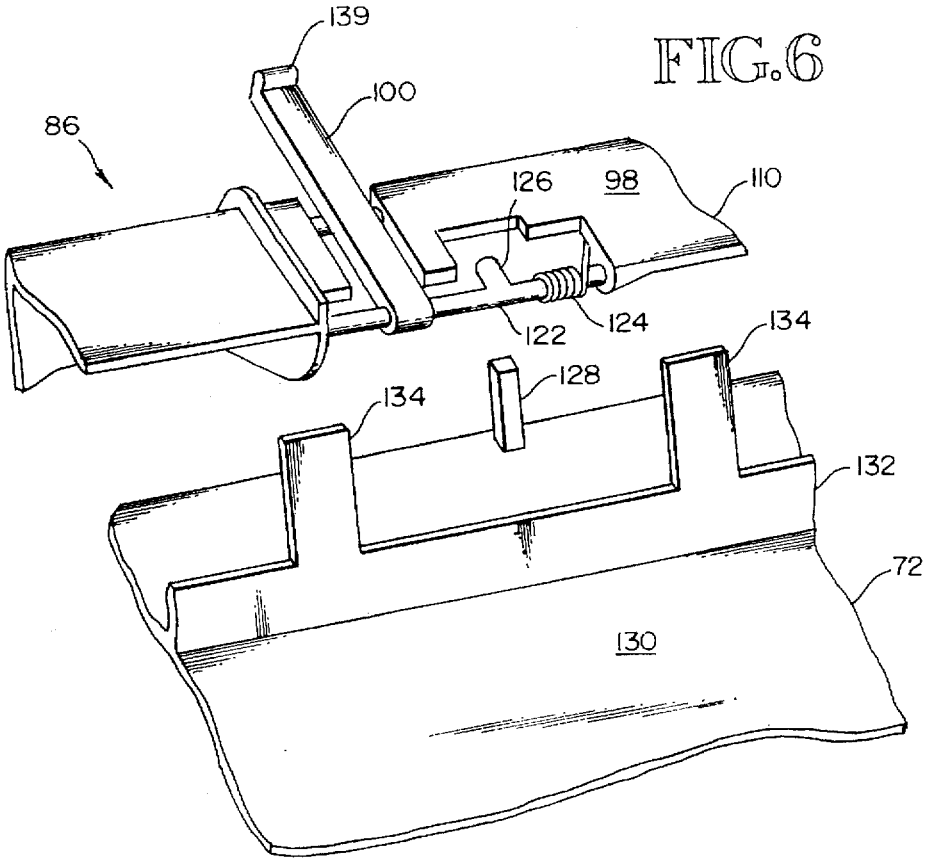
FIG. 6 is a perspective view of a portion of the pivot mechanism of FIG. 5 and a portion of the output tray of FIG. 3 showing the arm and posts according to an embodiment of this invention.

FIG. 6 shows a portion of the pivot mechanism 86 and a portion of the output tray 72. The pivot mechanism includes the arms 100. Each arm 100 is coupled to the platen 110 via a respective shaft 122. The shaft 122 and thus the arm 100 are biased by a spring 124 to a position in which the arm 100 is down toward the support surface 98. In a preferred embodiment the arm 100 is flush with or below the level of the support surface 98. In other embodiments the arm 100 is generally parallel to and slightly above the support surface level.

A cam protrusion 126 extends from the shaft 122. During movement of the pivot mechanism 86, the platen 110 is rotated down. The shaft 122 moves down with the platen 110 bringing the cam protrusion 126 into contact with a post 128 located in the vicinity of the output tray 72. In some embodiments the post 128 is part of the output tray 72. In the embodiment of FIG. 6 the output tray 72 includes a paper stack region 130, the post 128 (which serves as a first post), and a barrier 132 having two second posts 134. The barrier 132 isolates the paper stack region 130 from the pivot mechanism 86.

Figure 7:
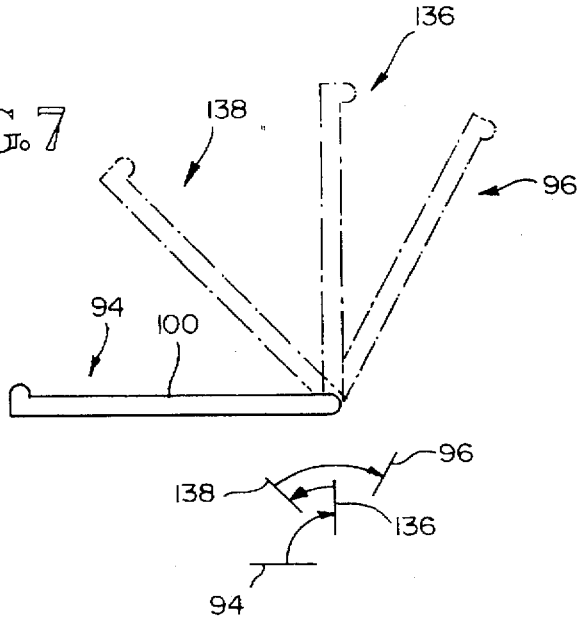
FIG. 7 is a diagram depicting the movement of the arm among various positions according to an embodiment of the method of this invention.

FIG. 7 shows the rotation of an arm 100. Such rotation is typical for each arm 100. When the cam protrusion is not in contact with the first post 128, the arm is in the first position 94. As the platen 110 rotates downward, the cam protrusion 126 contacts the first post 128. The first post 128 is fixed, whereas the cam protrusion 126 extends from the shaft 122 which rotates relative to the platen 110. Thus, as the platen 110 continues downward, a relative force between first post 128 and cam protrusion 126 pushes against the cam protrusion causing rotation of the shaft 122. The arm 100 rotates with the shaft 122, causing the arm to rotate up relative to the platen 110. Such upward rotation also is referred to herein as extending the arm 100. The arm rotates to an intermediary position 136. The motion of the platen 110 then reverses. Such reverse motion is achieved by reversing the direction of the drive motor 120. As a result, the pivot mechanism 86 rotates upward and the feed roller 66 reverses direction. The rotation of the feed roller 66 is incidental as the drive motor 120 is coupled to the pivot mechanism 86 via the link 116, kick-pick transmission 114, rocking mechanism 112, and gear transmission 164. As the platen 110 moves upward, the spring 124 biases the shaft 122 and cam protrusion 126 to rotate the arm 100 back toward the first position 94. The reverse motion continues for a prescribed rotation bringing the arm 100 to a second intermediary position 138. The drive motor 120 then changes direction again to the normal, forward direction. Thus, the pivot mechanism 86 changes direction to rotate the platen 110 downward. The cam protrusion 126 then is driven by the contact with the first post 128 causing the shaft 122 to rotate, and thus, extend the arm 100. The arm 100 rotates from the second intermediary position 138 to the second position 96. In a preferred embodiment a distal end 139 of each arm 100 extends at least to a plane of the barrier 132 of the output tray 72 while the arm 100 is in the second position 96. In one embodiment the arm extends over the plane of the barrier 132. The advantage of such extension is that the arm 100 pushes a media sheet 80 clear of the second posts 134 into the output stack area 130.

Rail Extensions

Figure 8:
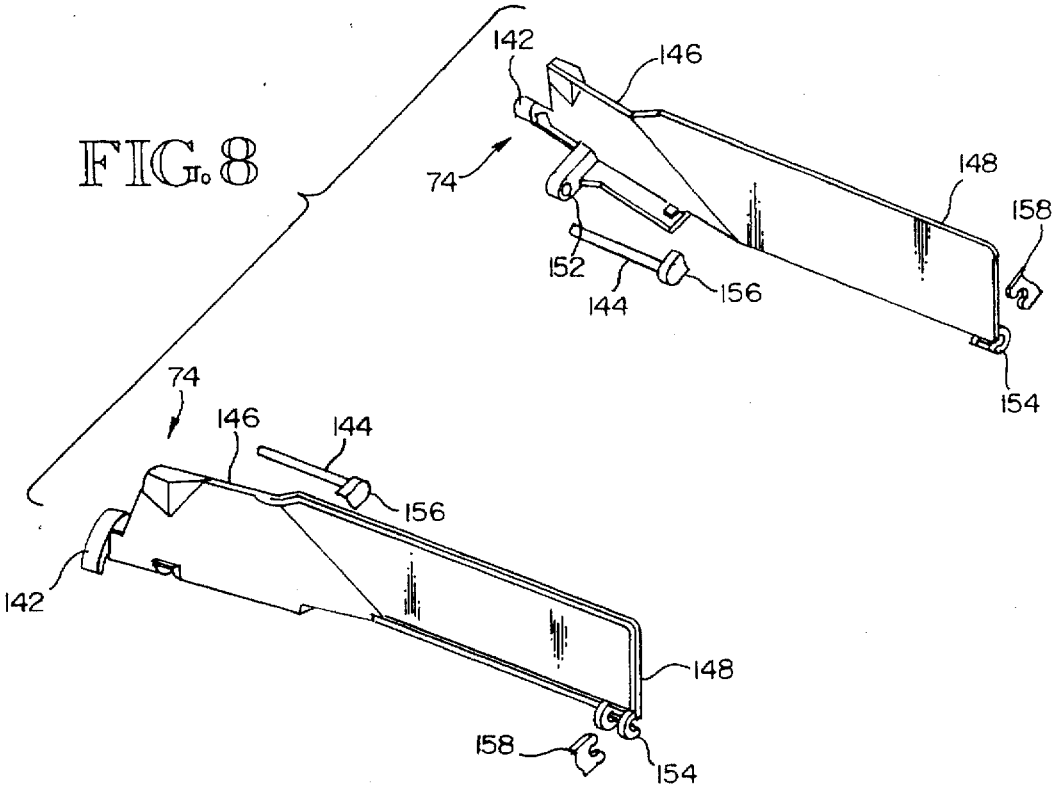
FIG. 8 is a perspective view of the rail extensions and mountings showing the rail extensions in an upward, retracted position.
Figure 9:
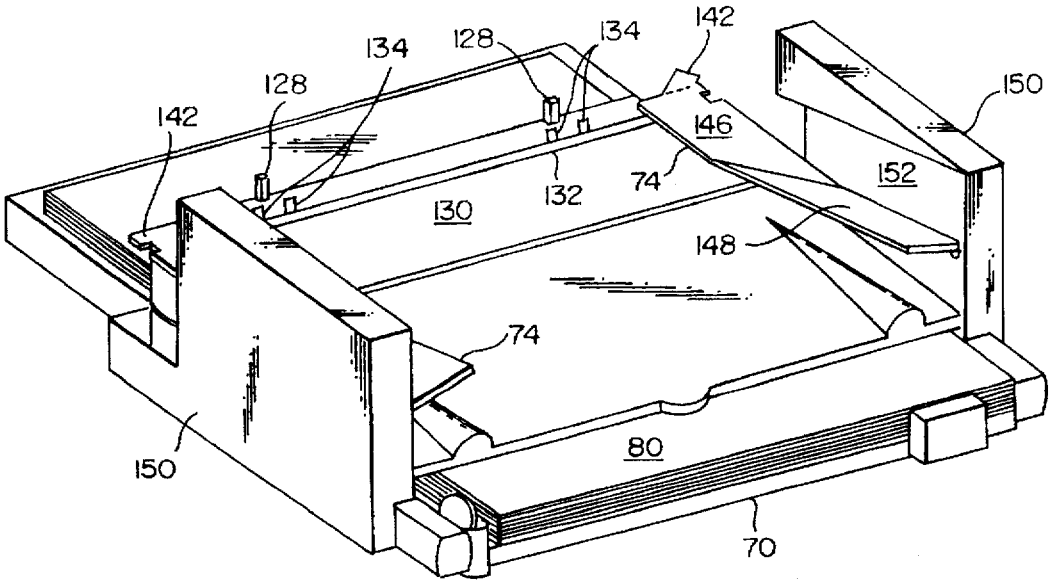
FIG. 9 is a perspective view of a portion of an inkjet printer showing the input tray, output tray, rail extensions and case sidewalls according to an embodiment of this invention.

FIGS. 8 and 9 show the rail extensions 74. In a preferred embodiment there are two rail extensions 74. Each extension 74 rotates between a down, extended position, and an up, retracted position. An axis of rotation for a given extension 74 is defined at coupling between the extension 74 and the inkjet printer wall 150 (See FIG. 9). In one embodiment each extension is coupled to the wall 150 in two locations. At one location an axle 144 extends from the wall 150 at a protrusion 156. The axle 144 mates into an opening 152 of the rail extension 74. At the other coupling location a protrusion 158 extending from the wall 150 receives engages a clasp 154 of the rail extension 74. The couplings for each rail extension 74 define an axis of rotation.

Figure 13:
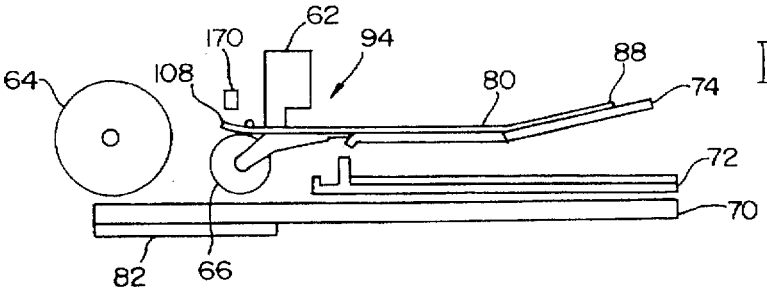
FIG. 13 is a diagram of the inkjet printer portion of FIG. 3 showing a portion of the media sheet being within the print zone.

FIG. 8 shows the rail extensions 74 in the retracted, up position. FIG. 9 shows the rail extensions 74 in the extended, down position. Each rail extension 74 includes a proximal end portion 146 located closest to the pivot mechanism 86 and print zone 102, and a distal end portion 148 located farthest from the pivot mechanism 86 and print zone 102. In a preferred embodiment the proximal end portions 146 are oriented to be generally level with the print zone 102 so as to keep the print media 80 flat within the print zone 102 (see FIG. 13). The distal end portions 148 are contoured relative to the proximal end portions 146 to elevate the lead edge of the media sheet 80 as the media sheet moves along the rail extensions 74.

Referring again to FIG. 5, the pivot mechanism 86 includes a respective portion 140 extending into contact with a lever portion 142 of a respective rail extension 74. While the pivot mechanism 86 is in the first position 94, the portions 140 are above the rail extension portions 142. As the pivot mechanism 86 moves downward, the portions 140 push the respective rail extension portions 142 downward. The downward force on the rail extension portions 142 rotates the rail extensions 74 upward from the extended position toward a retracted position. The walls 150 of the inkjet printer case have indented regions 152 into which the rail extensions 74 rotate when the rail extensions are fully retracted.

Handling and Ejection Method

Figure 10:
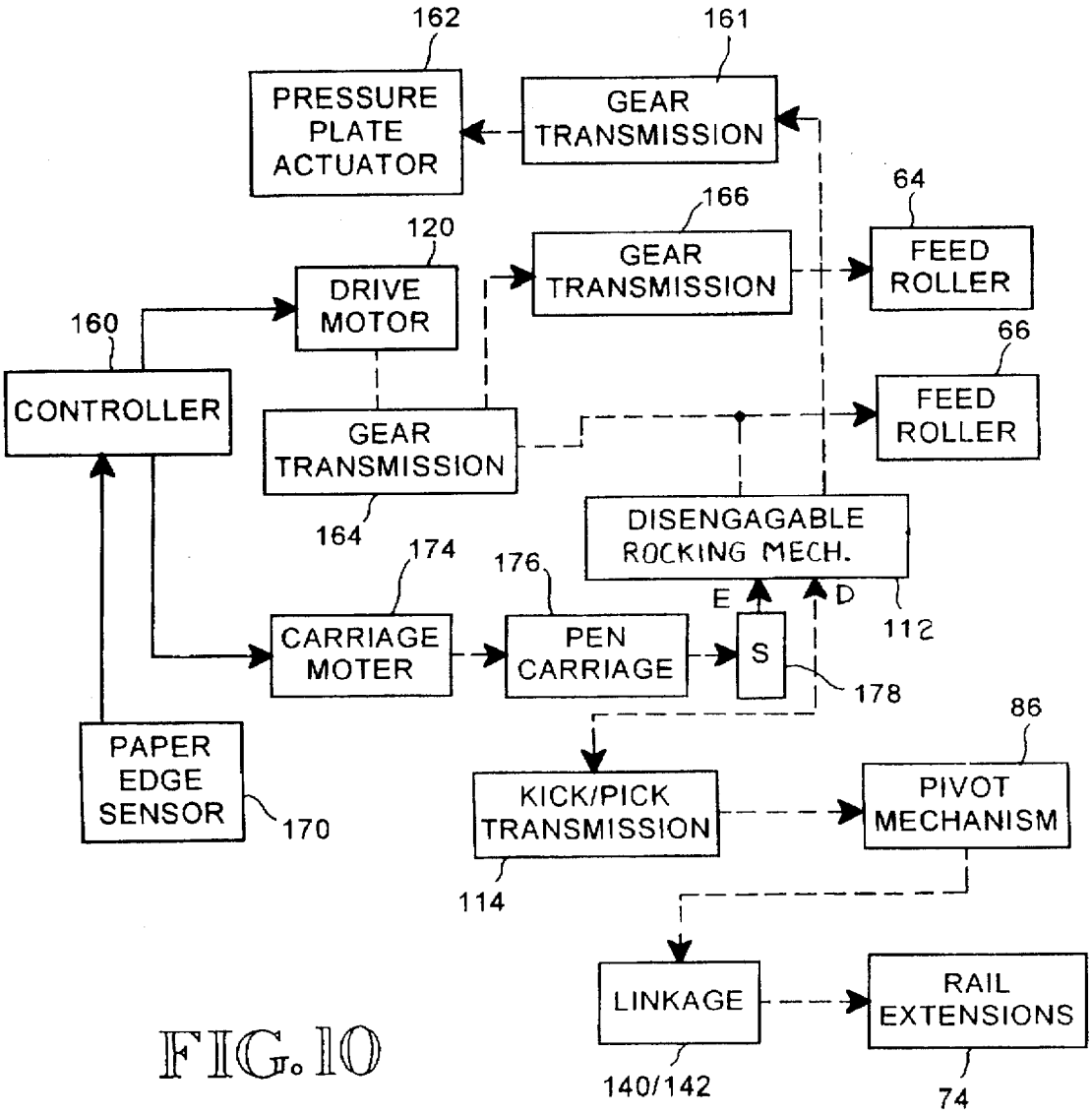
FIG. 10 is a block diagram depicting control flow of the inkjet printer components performing a handling and ejection method according to an embodiment of this invention.
Figure 11:
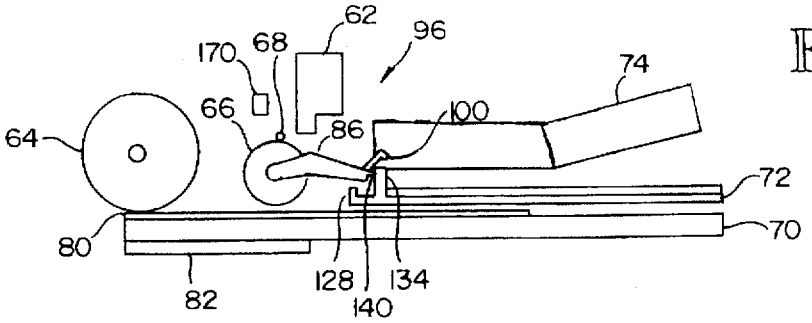
FIG. 11 is a diagram of the inkjet printer portion of FIG. 3 showing the pivot mechanism at the second position and between print jobs.

FIG. 10 shows a control flow diagram for a handling and ejection method embodiment of this invention. FIGS. 11–15 show the media sheet 80, pivot mechanism 86, an arm 100 and a rail extension 74 positions at various stages of the handling and ejection method. FIG. 11 depicts the components prior to and following a print operation. Prior to the print cycle, a media sheet 80 is the top sheet on an input stack within the input tray 70. The rollers 64 and 66 are stationary. The pivot mechanism 86 and arms 100 are in the second position 96. The rail extensions 74 are in the up, retracted positions.

When the printer receives a job to print, a controller 160 commands the drive motor 120 to start rotating in a forward direction. The drive motor 120 is linked to the pick and feed roller 64 via gear transmissions 164, 166 and to the feed roller 66 via gear transmission 164. Thus, the rollers 64, 66 begin rotating. At such time disengagable rocking mechanism 112 is engaged so as to link the kick/pick transmission 114 of the pivot mechanism 86 to the gear transmission 164 of the feed roller 66. A gear transmission 161 couples the pressure plate actuator 162 to the gear transmission 164 and drive motor 120 via the disengagable rocking mechanism. Thus, the pressure plate actuator 162 lifts the pressure plate 82 so as to push the top sheet 80 of an input paper stack against the pick and feed roller 64.

Figure 12:
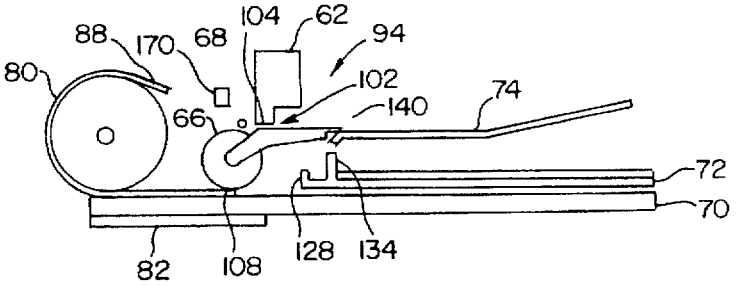
FIG. 12 is a diagram of the inkjet printer portion of FIG. 3 showing a media sheet at a position along a media path before the print zone.

As the feed roller 66 rotates, the pivot mechanism 86 moves from the second position 96 to the first position 94. As the pivot mechanism 86 moves from the second position 96 to the first position 94, the rail extensions 74 move from the retracted position to the extended position. FIG. 12 shows the pivot mechanism 86 in the first position 94, the rail extensions 74 in the extended position, and the media sheet 80 fed along the feed roller 64 toward the feed roller 66. When the pivot mechanism 86 reaches the first position 94, a gear of the kick/pick transmission 114 reaches an area without teeth causing the rocking mechanism 112 to rock back, disengage and break the link between the gear transmission 164 and the kick/pick transmission 114. Thus, while the feed rollers 64, 66 continue to rotate, the pivot mechanism 86 is locked in the first position 94. While in the first position 94, the support surface 98 on the pivot mechanism platen 110 forms a print zone 102 with the printhead 104 of the inkjet pen 62.

As the media sheet is fed into the print zone 102, ink is ejected from the printhead 104 onto the media sheet 80. During such printing, the controller 160 commands a carriage motor 174 to move the pen carriage 176 across the media sheet 80. The pen 62 is affixed to or resides in the pen carriage 176. The media sheet 80 is fed onto the rail extensions 74. The media sheet includes a lead edge 88, a trail edge 108 (see FIGS. 3, 12 and 13) and two side edges 182 (see FIG. 5). The media sheet 80 slides onto the rail extensions 74 at side portions 184 adjacent to the side edges 182.

Eventually enough of the media sheet 80 is fed through the media path that the trailing edge 108 of the media sheet 80 is detected by an edge sensor 170. Such edge sensor 170 is a photo-optic detector or a mechanical flag according to alternative embodiments. During the print cycle, the edge sensor 170 is polled by the controller 160 to identify when the leading edge 88, then trailing edge 108 enter the detection area of the edge sensor 170. For purposes of the ejection process, detection of the trailing edge 108 is of importance. Once the trailing edge 108 is detected, the controller 160 allows the drive motor 120 to continue for a predetermined time sufficient to allow the trailing edge 108 to move beyond the pinch roller 68, and to allow the pen 62 to finish printing to the media sheet 80. After such time, the controller 160 commands the carriage motor 174 to move the pen carriage to a switch 178 on the rocking mechanism 112. The pen carriage 176 or pen 62 contacts the switch 178 which in turn causes the rocking mechanism 112 to engage and re-establish the coupling between the feed roller's 66 gear transmission 164 and the pivot mechanism's 86 kick/pick transmission 114.

The pivot mechanism 86 then begins to move downward from the first position 94 toward the second position 96 as the feed roller 66 continues to rotate. Concurrently, portions 140 of the pivot mechanism 86 drive portions 142 of the rail extensions 74 downward causing a rotation of the rail extensions 74 upward toward the retracted position. As the rail extensions 74 rotate up, the media sheet 80 is raised. Because of the contour of the rail extensions, the lead edge 88 of the media sheet is elevated higher relative to the output tray 72 than the trailing edge 108. As the rail extensions 74 rotate upward, eventually the side edges 182 of the media sheet clear the rail extensions, allowing the media sheet 80 to fall toward the output tray 72. The media sheet 80 is oriented at a tilt back toward the pivot mechanism 86. Thus, the media sheet 80 trailing edge 108 remains in contact with the pivot mechanism 86.

Figure 14:
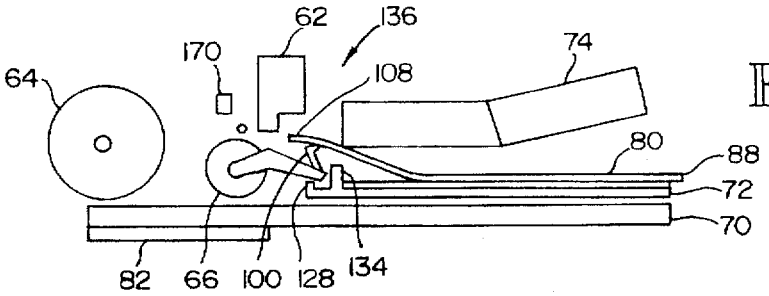
FIG. 14 is a diagram of the inkjet printer portion of FIG. 3 showing the pivot mechanism at the first intermediary position.
Figure 15:
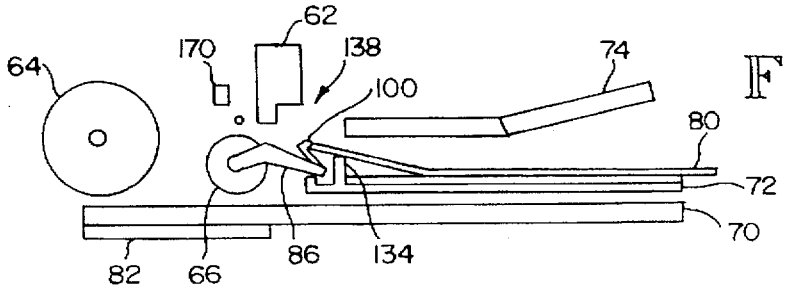
FIG. 15 is a diagram of the inkjet printer portion of FIG. 3 showing the pivot mechanism at the second intermediary position.

For a normal printing mode, the media sheet 80 usually falls from the rail extensions 74 during the motion from the first position 94 to the first intermediary position 136. Once the pivot mechanism 86 reaches a first intermediary position 136, the drive motor 120 reverses direction. The timing for when to reverse the drive motor 120 direction is a prescribed time increment following detection of the trailing edge 108 of the media sheet. More specifically, the detection of the trailing edge 108 by the edge sensor 170 serves to delineate a reference time or reference roller encoder position. The rollers 64, 66 rotate in digital increments using a digital encoding scheme. A prescribed time or correspondingly, a prescribed number of rotation units occur between detection of the trailing edge 108 and actuation of the carriage motor 174 to move the carriage 176 to the switch 178. A known time or number of rotation units occurs for the carriage motor 174 to respond and move the pen carriage to the switch 178, and for the switch 178 to cause the rocking mechanism 112 to couple the kick/pick transmission 114 to the gear transmission 64. Another known time or rotation unit increment occurs for the pivot mechanism to move to the first intermediary position 136. FIG. 14 shows the pivot mechanism and arms 100 in the first intermediary position 136 (also see FIG. 7).

Once the intermediary position (or more specifically the prescribed time or rotation unit increment) is reached, the controller 160 commands the drive motor 120 to reverse for a prescribed time period. In response the pivot mechanism 86 reverses direction and moves from the first intermediary position (see FIG. 14) to a second intermediary position 138 (see FIG. 15). The rail extension motion, being coupled to the pivot mechanism by the portions 140, 142 also reverses to move the rail extensions 74 toward the extended position.

Once the second intermediary position 138 is reached, the controller 160 commands the drive motor 120 to change direction again. The pivot mechanism 86 then commences rotating down from the second intermediary position 138 to the second position 96. The rail extensions 74 also change direction again and move to the retracted position. While the pivot mechanism 86 is in the second position 96 the rail extensions 74 are fully retracted to the printer sidewall indentations 152.

One purpose of the two changes in direction is to assure that the media sheet 80 clears the rail extensions 74. Another purpose is to enable a distal end 139 (see FIG. 6) of each arm 100 to move from under the media sheet 80 during the motion from the first intermediary position 136 to the second intermediary position 138. Thereafter, when the pivot mechanism changes direction again, each arm 100 extends with the distal end 139 in contact with the trailing edge 108 of the media sheet 80. As the pivot mechanism 86 moves to the second position 96 and the arms extend, the arms 100 push the media sheet 80 clear of the posts 134 onto an output stack within the output tray 72.

For slippery media sheets such as glossy paper, the movement of the pivot mechanism 86 from the first position to the first intermediary position 136, then back to the second intermediary position 138 and forward again to the second position 96 is performed at a reduced speed. The reduced speed releases the glossy sheet from the rail more gently, and pushes the glossy clear of the posts 134 onto the output stack more gently.

In a high speed mode of operation, the reversal of direction is omitted. Instead the pivot mechanism 86 pauses at the first intermediary position 136 for a prescribed time period. Thereafter, the pivot mechanism 86 continues a downward rotation toward the second position 96 rather than reversing to a second intermediary position 138. Thus, for the high speed mode there are no changes in direction, just a pause. For relatively short media (which typically are stiffer media), even when in high speed mode, the reversal of direction is implemented rather than just a pause. The edge sensor 170 detects the lead and trail edge of the media sheet and thus provides inputs to the controller 160 enabling the controller to implement the pause or reversal of direction in the high speed mode according to the length of the media 80.

Once the pivot mechanism 86 reaches the second position 96, the controller 160 stops the drive motor 120. In response the motion of the rollers 64, 66 and of the pivot mechanism 86 ceases. The pivot mechanism 86 remains in the second position with the rocking mechanism 112 engaged. When the next print cycle begins, the pivot mechanism 86 continues its rotation by rotating back up to the first position 94.

The movement of the pivot mechanism 86 and the rail extensions 74 is not motion at a constant rate like that for the conventional pivot mechanism 30 and rail extensions 22. According to an aspect of the invention, the motion of the pivot mechanism 86 is interrupted. The motion is reversed, and/or paused at an intermediary position 136. Similarly the motion of the rail extensions 74 and the arms 100 are interrupted, (e.g., paused and/or reversed).

Meritorious and Advantageous Effects

An advantage of the ejection method is that media sheets are moved from the rails to the output tray (i) without the media sheet sailing out of the output tray onto a desktop or floor, and (ii) without the media sheet getting stuck on the pivot mechanism and interfering with subsequent print cycles. Another advantage is that the reversal action frees the arms from the media sheet. Still another advantage is that the forward, reverse, forward action more reliably frees the media sheet from the rails. This is particularly beneficial for short or stiff media such as envelopes, which otherwise may get stuck on the rails.

An advantage of having the rail extensions contoured is that the media sheet tends to angle toward the print zone and pivot mechanism as the rails retract. The beneficial effect is that sailing of the media sheet out of the output tray when falling is avoided.

A beneficial effect of including a smaller diameter second feed roller is that the inkjet printer height is reduced, while still enabling relatively stiff media to be picked, wrapped around the larger diameter first roller, and fed toward the second roller and print zone for printing.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet printer comprising:

an input tray for holding a media sheet;

a first feed roller having a first diameter which picks the media sheet from the input tray and feeds the media sheet along a media path, the first feed roller picking the media sheet by moving the media sheet in a first direction and feeding the media sheet at least 180 degrees around the first feed roller and off the first feed roller, the first feed roller extending to a first height relative to the input tray;

a second feed roller having a second diameter smaller than the first diameter and receiving the media sheet from the first feed roller, the second feed roller extending to a second height relative to the input tray, wherein the second height is less than the first height;

an inkjet pen having a printhead at which ink is ejected, the printhead located adjacent to the second feed roller away from the first feed roller, the printhead located at a third height relative to the input tray, wherein the third height is less than the first height; and a support adjacent to the second feed roller and the printhead which supports a portion of the media sheet as the media sheet is fed from the second feed roller toward a media output area, wherein a print zone within which ink is printed onto the media sheet occurs between the printhead and the support.

2. The inkjet printer of claim 1, in which the support comprises a pivot mechanism, and wherein the pivot mechanism is movable automatically between a first position and a second position, the pivot mechanism supporting said portion of the media sheet adjacent to the printhead while in the first position.

3. The inkjet printer of claim 2, in which the pivot mechanism comprises a support surface and an arm, the support surface supporting said portion of the media sheet while the pivot mechanism is in the first position and being located toward the printhead, the arm extending higher than the support surface while the pivot mechanism is in the second position to push the media sheet from the support surface.

4. An inkjet printer comprising:

an input tray for holding a media sheet;

a first feed roller having a first diameter which picks the media sheet from the input tray and feeds the media sheet along a media path, the first feed roller extending to a first height relative to the input tray;

a second feed roller having a second diameter smaller than the first diameter and receiving the media sheet from the first feed roller, the second feed roller extending to a second height relative to the input tray, wherein the second height is less than the first height;

an inkjet pen having a printhead at which ink is ejected, the printhead located adjacent to the second feed roller away from the first feed roller, the printhead located at a third height relative to the input tray, wherein the third height is less than the first height; and a pivot mechanism located adjacent to the second feed roller and comprising a support surface and an arm, the pivot mechanism movable automatically between a first position and a second position via an intermediary position at which movement of the pivot mechanism is varied; and wherein while the pivot mechanism is in the first position, the support surface supports a portion of the media sheet as the media sheet is fed from the second feed roller toward a media output area; and wherein a print zone within which ink is printed onto the media sheet occurs between the printhead and the support surface while the pivot mechanism is in the first position; and wherein the arm extends higher than the support surface while the pivot mechanism is in the second position to push the media sheet from the support surface.

5. An inkjet printer for printing to a media sheet fed along a media path during a print cycle, comprising:

a roller receiving the media sheet along the media path during the print cycle;

an inkjet pen having a printhead at which ink is ejected, the printhead located adjacent to the roller;

a pivot mechanism located adjacent to the roller and comprising a support surface and an arm, the pivot mechanism movable automatically between a first position and a second position via an intermediary position at which movement of the pivot mechanism is varied; and a media output area at the end of the media path into which the media sheet is ejected;

wherein the roller feeds the media sheet adjacent to the printhead toward the media output area;

wherein while the pivot mechanism is in the first position, the support surface supports a portion of the media sheet as the media sheet is fed from the roller toward the media output area; and wherein a print zone within which ink is printed onto the media sheet occurs between the printhead and the support surface while the pivot mechanism is in the first position; and wherein the arm extends higher than the support surface while the pivot mechanism is in the second position to push the media sheet from the pivot mechanism into the media output area.

6. The printer of claim 5, further comprising:

an output tray within the media output area and adjacent to the pivot mechanism, the output tray comprising a region for holding media sheets and a first post between the holding region and the pivot mechanism; and a second post in the path of the pivot mechanism as the pivot mechanism moves between the first position and the second position, the second post contacting the pivot mechanism during movement of the pivot mechanism to move the arm higher than the pivot mechanism support surface.

7. The printer of claim 6, in which the pivot mechanism further comprises a cam to which the arm is coupled, the second post contacting the cam during movement of the pivot mechanism to rotate the cam and cause the arm to rotate so that an end of the arm extends higher than the pivot mechanism support surface, and wherein the extending of the arm pushes the media sheet from the pivot mechanism clear of the first post into the output tray.

8. The printer of claim 7, wherein the cam is a first cam and further comprising:

a rail support mechanism located above the output tray in the media output area, the rail support mechanism comprising a first rail support and a second rail support, each rail support movable between a first extended position and a second retracted position, each rail support extending in the output area away from the print zone and having a first end portion toward the print zone for supporting the media sheet and a second end portion away from the print zone for supporting the media sheet, wherein while in the extended position the second end portion is at a higher height above the output tray than the first end portion; and wherein the pivot mechanism further comprises:

a second cam for moving the first rail support as the pivot moves; and a third cam for moving the second rail support as the pivot moves.

9. The printer of claim 8, wherein the variation of movement of the pivot mechanism at the intermediary position comprises a pause of motion of the pivot mechanism for a prescribed time period; and wherein the rotation of said either one or both of the first rail support and the second rail support is varied with the variation of movement of the pivot mechanism so that said rotation of said either one or both of the first rail support and the second rail support is paused during the pause of motion of the pivot mechanism for the prescribed time period.

10. The printer of claim 8, wherein the variation of movement of the pivot mechanism at the intermediary position comprises a first change in direction of the pivot mechanism back toward the first position, and a second change in direction of the pivot mechanism back toward the second position;

wherein the rotation of said either one or both of the first rail support and the second rail support is varied with the variation of movement of the pivot mechanism so that said rotation of said either one or both of the first rail support and the second rail support undergo a first change in direction when the pivot mechanism undergoes the first change of direction and undergo a second change in direction when the pivot mechanism undergoes the second change in direction.

11. The printer of claim 5, wherein the variation of movement of the pivot mechanism at the intermediary position comprises a pause of motion of the pivot mechanism for a prescribed time period.

12. The printer of claim 5, wherein the variation of movement of the pivot mechanism at the intermediary position comprises a first change in direction of the pivot mechanism back toward the first position, and a second change in direction of the pivot mechanism back toward the second position.

13. A method for ejecting a media sheet in an inkjet printer, comprising the steps of:

feeding a media sheet through a print zone and onto first and second rail supports in an output region of the printer, wherein the media sheet has a lead edge, a trailing edge, a first side edge and a second side edge, the media sheet also having a first side portion in the vicinity of the first side edge and a second side portion in the vicinity of the second side edge, and wherein the print zone is formed between a printhead of an inkjet pen and a support surface of a pivot mechanism, and wherein the rail supports are elevated above an output tray, the first rail support supporting the media sheet at the first side portion and the second rail support supporting the media sheet at the second side portion, the rails supports movable between respective extended positions and respective retracted positions;

moving the pivot mechanism away from a first position at which the support surface of the pivot mechanism supports a portion of the media sheet adjacent to the printhead to a second position away from the printhead, wherein movement of the pivot mechanism is varied when the pivot mechanism reaches an intermediary position between the first position and second position;

during the step of moving away from the first position, rotating either one or both of the first rail support and the second rail support upward and toward the respective retracted positions to allow the media sheet to fall toward the output tray, wherein as said either one or both of the rail supports rotate and the pivot mechanism moves, the media sheet initially tilts at an angle to have the trailing edge at a lower height relative to the output tray than the lead edge;

during the movement of the pivot mechanism away from the first position to the intermediate position, extending an end of an arm of the pivot mechanism to a first height above the support surface of the pivot mechanism to push a portion of the media sheet in contact with the arm end from the support surface;

during the movement of the pivot mechanism beyond the intermediary position to the second position, extending the end of an arm of the pivot mechanism to a second height above the support surface of the pivot mechanism to push any portion of the media sheet in contact with the arm end from the pivot mechanism, wherein the second height exceeds the first height.

14. The method of claim 13, wherein the variation of movement of the pivot mechanism at the intermediary position comprises a pause of motion of the pivot mechanism for a prescribed time period.

15. The method of claim 14, wherein the rotation of said either one or both of the first rail support and the second rail support is varied with the variation of movement of the pivot mechanism so that said rotation of said either one or both of the first rail support and the second rail support is paused during the pause of motion of the pivot mechanism for the prescribed time period.

16. The method of claim 13, further comprising the steps of detecting the lead edge and trail edge of the media sheet, and wherein the variation of movement of the pivot mechanism at the intermediary position comprises either one of a pause of motion of the pivot mechanism for a prescribed time period or a reversal of direction, and wherein the variation of movement is one of either the pause of motion or the reversal of direction for a media sheet having a length from lead edge to trail edge which is less than a threshold length, and wherein the variation of movement is the other of either the pause of motion or the reversal of direction for a media sheet having a length from lead edge to trail edge which is greater than a threshold length.

17. The method of claim 13, further comprising the steps of detecting the lead edge and trail edge of the media sheet, and wherein the variation of movement is one variation for a media sheet having a length from lead edge to trail edge which is less than a threshold length and the variation of movement is another variation for a media sheet having a length from lead edge to trail edge which is greater than the threshold length.

18. The method of claim 13, wherein the variation of movement of the pivot mechanism at the intermediary position comprises a first change in direction of the pivot mechanism back toward the first position, and a second change in direction of the pivot mechanism back toward the second position.

19. The method of claim 18, wherein the output tray has a holding region for stacking media sheets and the printer has a first post located between the holding region and the pivot mechanism and a second post in the path of the pivot mechanism as the pivot mechanism moves between the first position and the second position, the second post contacting the pivot mechanism during movement of the pivot mechanism to move an end of the arm higher than the pivot mechanism support surface, wherein the movement of the arm undergoes a first change in direction as the pivot mechanism moves back toward the first position, and a second change in direction as the pivot mechanism moves back toward the second position, wherein a distal tip of the arm clears the media sheet before the second change in direction of the arm to enable the end of the arm to push the media sheet from the pivot mechanism clear of the first post into the output tray while the pivot mechanism moves to the second position.

20. The method of claim 18, wherein the rotation of said either one or both of the first rail support and the second rail support is varied with the variation of movement of the pivot mechanism so that said rotation of said either one or both of the first rail support and the second rail support undergo a first change in direction when the pivot mechanism undergoes the first change of direction and undergo a second change in direction when the pivot mechanism undergoes the second change in direction.

21. The method of claim 13, wherein the output tray has a holding region for stacking media sheets and the printer has a first post located between the holding region and the pivot mechanism and a second post in the path of the pivot mechanism as the pivot mechanism moves between the first position and the second position, the second post contacting the pivot mechanism during movement of the pivot mechanism to move an end of the arm higher than the pivot mechanism support surface, wherein the movement of the arm pushes the media sheet from the pivot mechanism clear of the first post into the output tray.

22. A method for ejecting a media sheet in an inkjet printer, comprising the steps of:

feeding a media sheet through a print zone and onto first and second rail supports in an output region of the printer, wherein the media sheet has a lead edge, a trailing edge, a first side edge and a second side edge, the media sheet also having a first side portion in the vicinity of the first side edge and a second side portion in the vicinity of the second side edge, and wherein the print zone is formed between a printhead of an inkjet pen and a support surface of a pivot mechanism, and wherein the rail supports are elevated above an output tray, the first rail support supporting the media sheet at the first side portion and the second rail support supporting the media sheet at the second side portion, the rails supports movable between respective extended positions and respective retracted positions;

moving the pivot mechanism away from a first position at which the support surface of the pivot mechanism supports a portion of the media sheet adjacent to the printhead to an intermediary position;

during the step of moving away from the first position, rotating either one or both of the first rail support and the second rail support toward the respective retracted positions to allow the media sheet to fall toward the output tray, wherein as said either one or both of the rail supports rotate and the pivot mechanism moves to the intermediary position, the media sheet tilts at an angle to have the trailing edge at a lower height relative to the output tray than the lead edge;

during the step of moving away from the first position, extending an end of an arm of the pivot mechanism to a first height above the support surface of the pivot mechanism to push a portion of the media sheet in contact with the arm end from the support surface;

moving the pivot mechanism back toward the first position;

during the step of moving back toward the first position, rotating said either one or both of the first rail support and the second rail support back toward the respective extended positions;

after the steps of moving back toward the first position and rotating back toward the respective extended positions, moving the pivot mechanism in a direction away from the first position through the intermediary position to a second position;

during the step of moving to the second position, rotating said either one or both of the first rail support and the second rail support toward the respective retracted positions; and during the step of moving to the second position, extending the end of the arm of the pivot mechanism to a second height above the support surface of the pivot mechanism to push a portion of the media sheet in contact with the arm end from the pivot mechanism, wherein the second height exceeds the first height.

* * * * *